US006182669B1

(12) United States Patent
van der Elst

(10) Patent No.: US 6,182,669 B1
(45) Date of Patent: Feb. 6, 2001

(54) REQUISITE FOR REDUCING EMISSIONS OF SIDE STREAM SMOKE FROM A CIGARETTE

(75) Inventor: Gabriel van der Elst, Geneva (CH)

(73) Assignee: Alain Colens (BE); a part interest ( * ) Notice: Under 35 U.S.C. 154(b), the term of this patent shall be extended for 0 days.

(21) Appl. No.: 08/973,261

(22) PCT Filed: Jun. 10, 1996

(86) PCT No.: PCT/BE96/00057

§ 371 Date: Dec. 3, 1997

§ 102(e) Date: Dec. 3, 1997

(87) PCT Pub. No.: WO96/41546

PCT Pub. Date: Dec. 27, 1996

(30) Foreign Application Priority Data

Jun. 8, 1995 (DE) ..... 95 00 502

(51) Int. Cl.[7] ..... A24F 9/14; A24F 13/02; A24D 3/04

(52) U.S. Cl. ..... 131/257; 131/187; 131/256; 131/338; 131/329

(58) Field of Search ..... 131/175, 349, 131/257, 329, 174, 187, 190, 330, 256, 338, 235.1, 240.1, 242, 241, 173; 206/242

(56) References Cited

U.S. PATENT DOCUMENTS

| | | | | |
|---|---|---|---|---|
| 1,770,616 | * | 7/1930 | Kean | 131/349 |
| 1,862,679 | * | 6/1932 | Holsman | 131/257 |
| 4,703,766 | * | 11/1987 | Wargo | 131/175 |
| 5,080,113 | * | 1/1992 | Bui | 131/173 |

FOREIGN PATENT DOCUMENTS

| | | | |
|---|---|---|---|
| 1 479 458 | * | 7/1977 | (GB) . |
| WO 96/22031 | * | 7/1996 | (WO) . |

* cited by examiner

*Primary Examiner*—Stanley S. Silverman
*Assistant Examiner*—Dionne A. Walls
(74) *Attorney, Agent, or Firm*—Leonard Bloom

(57) ABSTRACT

A smoker's requisite for reducing the amount of smoke given off by the smouldering tip of a cigarette. The requisite consists of a rigid sleeve that may be slid along a cigarette and momentarily positioned over the smouldering tip thereof then withdrawn to enable the smoker to take a puff from the opposite end in a conventional way. The sleeve advantageously comprises a finger engaging gripping and supporting portion providing ventilation of the cigarette body, and a briar wood portion designed to be controllably moved over the smouldering tip.

3 Claims, 3 Drawing Sheets

REQUISITE FOR REDUCING EMISSIONS OF SIDE STREAM SMOKE FROM A CIGARETTE

This invention relates to a requisite for smokers for reducing the amount of smoke emitted by a cigarette, in particular reducing the amount of so-called "side-stream smoke".

This latter smoke is the smoke emitted by the smoldering tip of the cigarette. It is particularly visible between two inhalations of the smoker, for example when the cigarette lies in an ashtray.

Different systems have already been put forward to this end. They are often complicated, cumbersome and not very effective. To the knowledge of the applicant no requisite of this type has been marketed.

Recently (WO95/10200), requisites were put forward that are capable of retaining in a chamber ("wrap up") the smoke emitted by the tip of the cigarette which is then filtered prior to reaching the outside. The supply of air is provided in a passive manner and the chamber can be a cardboard box capable of being manipulated with one hand and also fulfilling the function of ashtray. These requisites are effective and constitute a significant progress. They nevertheless remain relatively cumbersome and have psychological disadvantages for the smoker, e.g. the partial non-visibility of the cigarette.

According to the document of patent GB 2.157.541, it has also be established that it is possible to reduce the side-stream smoke produced during the smoldering of a cigarette, by fitting a simple sleeve to this that surrounds it, sleeve or ring capable of friction sliding, and whose position can be regulated at any time by the smoker.

The sleeve is in the form of a pipe segment, preferably rigid, of internal diameter approximately equal to the diameter of a cigarette. This sleeve is in metal, plastic or in the form of a thin layer of rolled-up inorganic paper.

When the extremity of the sleeve covers the smoldering tip or the boundary between this latter and the unburned paper, the relatively quick smoldering of the cigarette is greatly reduced and the visible smoke emitted from it almost disappears. The side supply of oxygen is indeed cut off. The cigarette only goes out after a lapse of time of the order of 1 to 2 minutes.

This system comprises certain disadvantages, for example the difficulty of utilization which has to become instinctive, the traces of condensation which appear on the outer and inner walls, fouling and an alteration of the flavor due to the material used.

To the knowledge of the applicant, no device of this type has yet been marketed.

This invention consists in providing considerable improvements to this type of device by facilitating its handling by the smoker who utilizes it and by facilitating a daily and hygienic utilization.

According to one aspect of the invention, a device is indeed put forward comprising at least one part covering or close to the smoldering tip of the cigarette (distal part) and a distinct gripping part which serves for handling (proximal part).

According to the invention, the part covering or close to the smoldering tip of the cigarette is imperforate and is made of a material utilized for traditional pipe bowls, more especially briar wood or meerschaum.

The above mentioned parts are preferentially in the form of distinct longitudinal segments made to form one piece by friction, screwing or gluing.

These latter materials are nevertheless not very dimensionally stable and are relatively costly. According to another aspect of the invention, the requisite consequently comprises a gripping part in a more stable and more economical material, for example another wood or a plastic. This aspect of the invention enables industrial manufacturing.

The sleeve according to the invention operates like a controlled effect extinguisher. It can be pushed toward the smoldering tip and returned to a more proximal position, generally with the fingers of the free hand of the smoker. Handling can also, advantageously, be done with the fingers of the hand that holds the cigarette, for example with the thumb for pushing the cigarette on the one hand and the thumb and the ring finger for withdrawing the cigarette. In order to slide a very light sleeve, just the index finger can be used.

The movement of the sleeve along the cigarette can also be effected by holding the cigarette between the lips, the index finger and the middle finger taking hold of the requisite as they would take hold of a cigarette conventionally and sliding it.

When the smoker wishes to inhale smoke, he moves the sleeve as mentioned above freeing the smoldering tip. Inhalation can then take place normally. After inhalation, the sleeve is returned and the process is advantageously repeated for each inhalation. The unburned part of the paper of the cigarette is thus returned inside the sleeve between each inhalation.

Other techniques for smoking with this device can be adopted. The cigarette can thus be moved forward in the sleeve by a distance that depends on the manner of inhaling of the smoker so that the burned part of the cigarette essentially corresponds to the emergent part of the extremity. According to other variants inhalation with the lighted tip in the sleeve is possible.

The user can easily acquire a certain dexterity for moving the sleeve along the cigarette and thus controlling the secondary emission of smoke. If at the beginning accidental extinctions can occur, this dexterity very quickly becomes effective and natural and even instinctive.

The duration of smoldering of the cigarette is generally increased. In normal use, and depending on the length of the sleeve, the presence of this latter nevertheless stops the cigarettes from being smoked right up to the filter tip which constitutes an advantage insofar as it is this last part that is recognized as being the most harmful (tar, nicotine, heat). If the user so wishes, the sleeve can be retracted at any time and the remainder of the cigarette smoked as usual.

In economic terms, the invention can also procure numerous advantages due to slower smoldering. Furthermore the requisite enables the extinction and relighting of a cigarette as desired without an ashtray being necessary, and without substantial alteration to flavor, unaesthetic stubbing out of the cigarette end, or moreover emission of smoke when extinguishing.

Irrespective of the beneficial effect on the emission of smoke, the slowing down of the smoldering can be desired in environments where this is too fast, e.g. in open air and when it is windy.

Advantageously, given that the wall of the sleeve near the distal part is relatively thick (over 2 mm), the requisite according to the invention can be placed horizontally on a table with the lit cigarette inserted in it. The distance between the supporting surface and the smoldering tip prevents all burning of the aforesaid surface and if the cigarette is forgotten, it will go out automatically.

According to the invention, the sleeve is a short sleeve of a material non-inflammable at the temperature of the smoldering tip of the cigarette. The sleeve comprises at least two functionally different parts namely a gripping proximal part and a distal part forming a controlled ventilation combustion chamber.

Preferably, the device according to the invention will be made from a wood, more preferentially a wood able to serve for manufacturing traditional pipes, in particular pipe bowls. This could for example be briar or boxwood.

These woods constitute a particularly advantageous material, among others because the flavor of the smoke inhaled is not or hardly altered.

The sleeve can be formed by turnery. For products according to the invention only to be used a limited number of times, e.g. so-called "throw-away" products, more readily available woods can be utilized (e.g. so-called alimentary woods such as beech) or economical materials known for making pipes (corn-cob).

Heat stability, in particular for the top of the range products, is important in order to enable a constant friction between the cigarette and the device according to the invention. If the diameter of the sleeve increases too significantly under the effect of the heat, this risks sliding and falling away from the body of the cigarette.

According to one embodiment of the invention, the sleeve is made of two separable parts. The two parts can be of different materials, for example in different types of woods.

Two parts can thus be provided capable of being reversibly separable, e.g. simply forming one piece by friction, and the requisite is then modifiable. The proximal, gripping part can then be designed as a more worked and decorative element, and the distal part adapting by friction would be in wood and, according to a variant, replaceable such as a cartridge after having smoked a certain number of cigarettes.

As stated, these two parts can therefore consist of different materials, for example briar for the distal part and plastic for the proximal part.

The length of the sleeve is preferably such that the two fingers holding the cigarette must easily be able to hold the sleeve by its proximal part, the distal part only being destined to receive or be close to the smoldering tip and being generally considerably hotter. The proximal part advantageously comprises at least a hollow or an annular groove destined to receive the fingers of the user holding the sleeve with the cigarette inserted therein.

The total length will typically be between 2 and 5 cm, preferably 2.8 to 4.0 cm. A length of 3.2 cm has proved satisfactory for a great number of different models.

According to an embodiment of the invention, the configuration of the proximal part of the sleeve can advantageously be adapted in a way to leave a ventilation under this part. Openings or slits can thus be provided which enable the cigarette paper to be directly in contact with the outside. This characteristic enables an undesirable condensation inside the sleeve to be avoided. The percentage of the ventilated surface may exceed 40%.

This interior face of this proximal part can also have longitudinal grooves which only rest by friction on the body of the cigarette and thus make the ventilation of the paper much easier.

The distal part of the device can comprise longitudinal or transverse fins which dissipate the heat transmitted by the smoldering tip. This enables involuntary burns by contact of a finger on this part to be avoided which, depending on the material utilized, can in reality be very hot.

According to a less preferred embodiment of the invention at present, the distal and proximal part nevertheless form a single body in wood comprising several integrated segments (gripping segment—combustion chamber segment).

According to a variant the extremity of the distal part nevertheless comprises an interior annular seating (facing) in which a ring of a better adapted and more heat-resistant material is attached by friction, in particular in briar, meerschaum or in terra cotta. The wall of the ring advantageously has a thickness greater than 1 mm (generally from 0.5 mm to 4.5 mm). The ring can easily be replaced or simply removed and put back, returned, in the annular seating thus offering a new annular fireplace zone.

In all cases, a plug that adapts itself in the distal opening of the sleeve when this is not utilized can advantageously be provided. This characteristic enables on the one hand the user to be protected from the burned part and therefore from being dirtied by the object, for example when this is pocketed and on the other hand from the inside wall of the distal part to be cleaned which possibly comprises a tarry deposit. According to an additional characteristic, the plug is a cleaning plug that has an abrasive wall capable of removing all deposits from the inside wall of the tube at its distal extremity. The plug can advantageously be adapted for also covering a part of the outside wall of the distal part of the sleeve. According to another variant the plug screws onto a thread present on the exterior surface of the distal part of the sleeve, screw thread capable of serving as cooling "fins", as mentioned above.

An independent abrasive element can also be provided in the form of a tube or a rod whose exterior surface is abrasive, the tube being slightly conical and suitable for being inserted via the distal part of the sleeve.

According to a variant, the sleeve according to the invention is in a container, for example in the form of a case, preferably rigid. This case comprises the two complementary parts, forming one piece or adaptable by friction. A plug forming element, abrasive tube or abrasive rod can be connected to the case which thus constitutes a kit. This kit can comprise several sleeves or sleeve parts according to the invention.

Generally, the user could possess several requisites according to the invention in order to be able to smoke in different circumstances and with slightly different flavors, and thus increase the ludic aspect of the invention. A sleeve can thus be left to cool off or "rest", by utilizing another model. The method will be rather close to that of pipe smokers.

According to another aspect of the invention a guard can be provided at the end of the sleeve, or preferably at the end of the aforesaid proximal part of the sleeve in the form of an annular flange extending more or less perpendicular to the axis of the sleeve and surrounding it. This element, by being an obstacle, enables the residual smoke which is produced, to contaminate the fingers of the smoker less.

An ergonomic form for being held between the fingers of the user can advantageously be adapted by arranging, in combination or not with the aforesaid flange, for the fingers thus to fit into a well-formed annular groove.

Finally, the proximal extremity of the requisite can have a bevel-edged opening or a funnel-shaped opening in order to facilitate the insertion of the cigarette into the sleeve, generally prior to lighting the cigarette.

According to a particularly preferred embodiment of the invention at present, the device put forward consists of three segments:

a proximal part destined to be gripped by the fingers of the user, which can be separable. The wall is preferably widely perforated. When the impermeable intermediate part described below is integrated into the proximal part the diameter of this is preferably very slightly greater than the diameter of a cigarette thus enabling the subjacent cigarette paper to breath. This part is preferably light, non-inflammable, very well ventilated and stable.

a shorter, annular impermeable part of diameter such that the friction of the cigarette is greater there than that of the distal part and possibly of the proximal part. This impermeable part corresponds e.g. to a segment of 0.2 to 0.5 cm. The impermeable part prevents the passage of air and/or smoke, along the outside wall of the cigarette, between the proximal part and the distal part. This characteristic prevents, among others, all staining of the proximal part, e.g. by condensation of smoke, as well as all emission of smoke coming from a supply of air coming from the proximal part, along the cigarette paper.

a combustion chamber forming part, destined to receive or be close to the smoldering tip of the cigarette, the corresponding diameter being slightly greater and, preferably, enabling the paper not to be in contact with the inside wall of this distal part.

The invention will be better understood by examining the attached drawings provided only by way of example.

Figure 1:
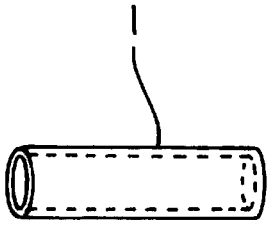
FIG. 1 PRIOR ART
FIG. 1 is a representation of a simple sleeve 1 according to former skills.
Figure 4:
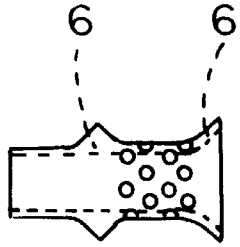
FIG. 4 represents a sleeve according to the invention with a gripping part comprising extremity flanges 6 promoting the holding or handling of the sleeve between the fingers of the user. The distal part is on the left, and is imperforate.
Figure 2:
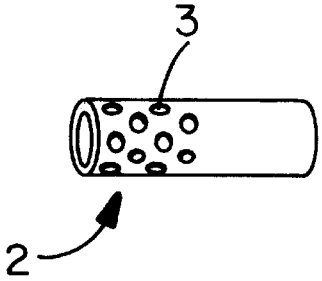
FIG. 2 PRIOR ART
FIG. 2 is a representation of a sleeve according to former skills with a proximal part 2 mouth side pierced with circular holes 3.
Figure 5:
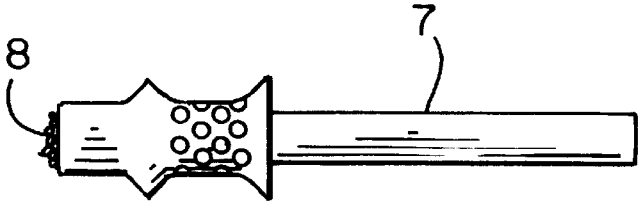

FIG. 5 represents a requisite according to FIG. 4 to which a cigarette 7 in waiting position is associated, in other words without inhalation. The incandescent ashes 8 do not smoke or hardly at all when they are inside the distal part of the sleeve. The extremity of this part is near the unburned paper.

Figure 6:
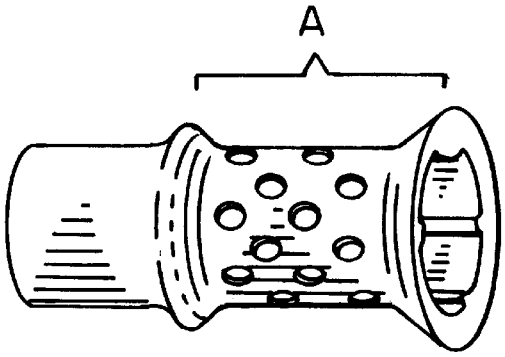
Figure 3:
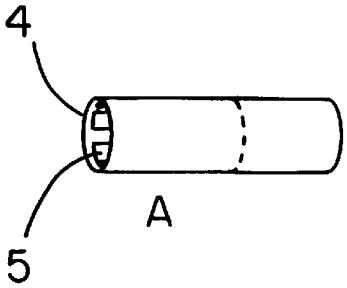
FIG. 3 PRIOR ART
FIG. 3 is a representation of a sleeve that has a bevelled edge 4 and an internal slotting 5 promoting the ventilation of the paper, the slotting only extending over the proximal part A of the sleeve. This embodiment can also comprise openings according to FIG. 2.

FIG. 6 is a figure in perspective of the requisite according to FIGS. 4 and 5.

Figure 7:
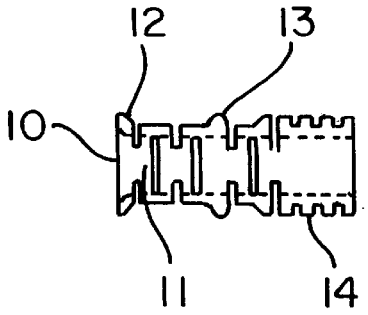
Figure 8:
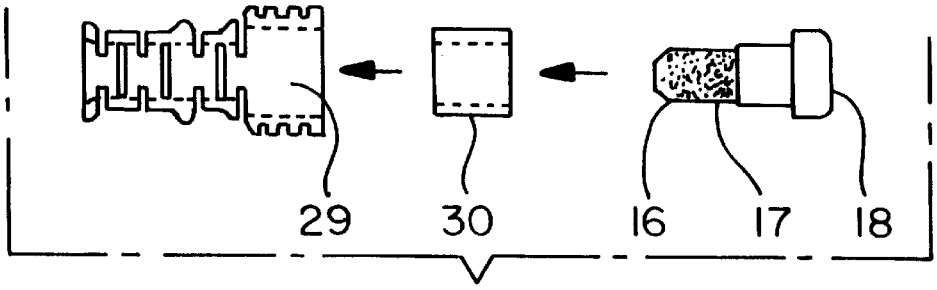

FIGS. 7 and 8 represent longitudinal views of devices according to the invention in which the holes of the proximal part have elongated and transverse forms.

In 10 a slightly funnel-shaped hole is distinguished that facilitates the insertion of the cigarette and leads to an inside channel of 8 mm diameter, represented in dashed-dotted lines, depending on the diameter of the cigarettes utilized, standardized diameter on some type values on the market. In 11 are distinguished the transversally elongated ventilation openings, the flanges 12 and 13 facilitating holding between the fingers, the fins 14 promoting cooling and reducing the temperature of the object and thus enabling all accidental burns to be avoided.

The distal part of the device illustrated in FIG. 8 comprises a seating in which a ring 30 can be attached by friction, ring which will be in a material more resistant to heat than the main body of the object. Also illustrated is a plug adaptable by friction and comprising a conical part 16, an abrasive cylindrical part 17 enabling possible deposits to be eliminated which would impede the proper sliding of the cigarette or the readjustment of the diameter of the fireplace if this is made of a material capable of "moving" (for example briar, in particular being "run-in"). The head of the plug 18 can comprise a peripheral turned-down part (not illustrated) partially extending over the external surface of the sleeve.

Figure 9A:
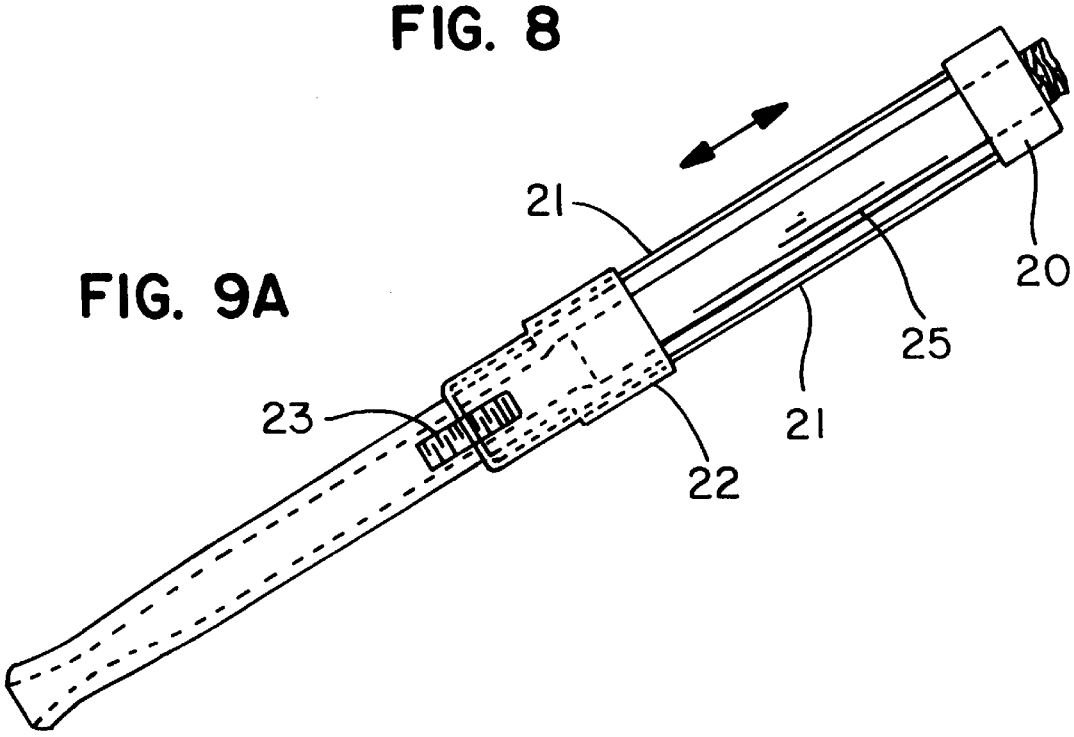
Figure 9B:
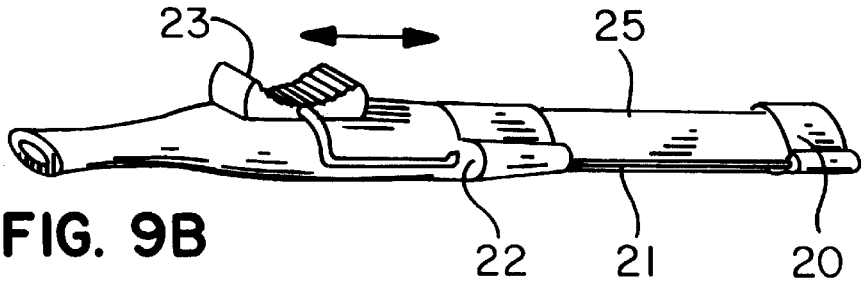

FIGS. 9*a* and 9*b* illustrate an example of cigarette-holder to which a device according to the aspect of the invention has been adapted. The sleeve 20 is distinguished which slides along the cigarette 25, forming one piece with the lateral rods 21 (here two rods, of which only one is represented in FIG. 9*b*) sliding into an element of the cigarette-holder equipped with channels or sliding grooves 22, a control element 23, forming one piece with the rods and enabling the sleeve to be slid along the cigarette with the help of a finger, this control element being a button itself sliding on the upper part of the body of the cigarette-holder.

Figure 10:
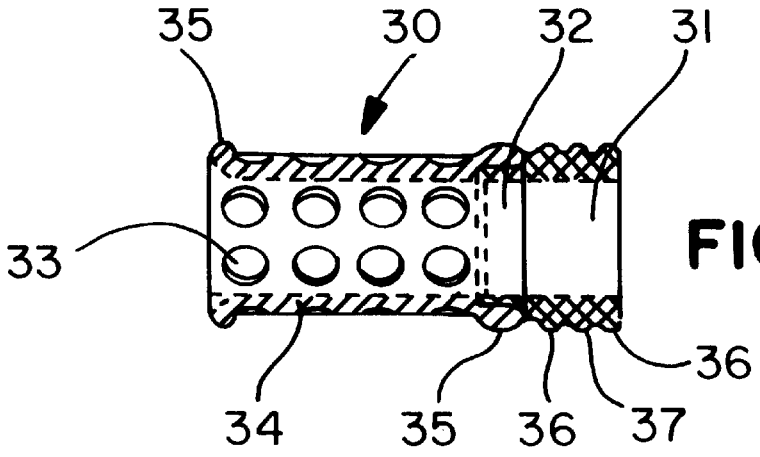

FIG. 10 illustrates a requisite according to the invention preferred at present. Distinguished there are the proximal part 30, the distal part 31 and the impermeable intermediate part 32 of internal diameter slightly less (from 0.04 to 0.08 mm) than the internal diameters of the distal part and possibly, of the proximal part when this latter is integrated into the impermeable/choke part. The intermediate part forms one piece with and integral to the distal part which is made of a material 37 which can be briar wood. The length of the intermediate part can vary e.g. from 2 to 5 mm. Holes 33 of 3 mm diameter, which can be as many as 32, traversing the proximal part, manufactured of a material 34 such as boxwood or a plastic, in order to ventilate the subjacent paper more. Two flanges 35 are also distinguished integrated into the proximal part and the cooling fins (36 in section).

Figure 11:
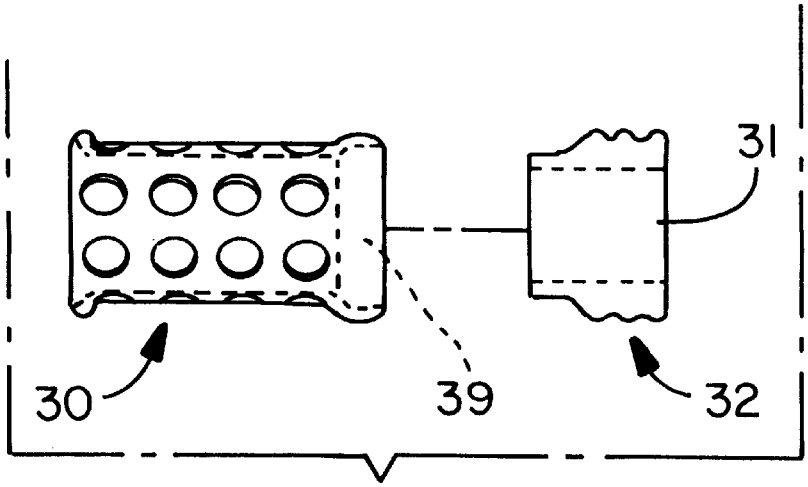

FIG. 11 illustrates the same requisite, on true scale this time (3 cm in length), separated into these two components normally forming one piece by friction or gluing. The cavity 39 is distinguished in which lodges the intermediate part 32 of a diameter of 8.0 mm extended by the distal part. The distal part is equipped with transverse fins, the exterior diameter being 14 mm and the interior diameter 8.07 mm.

Figure 12:
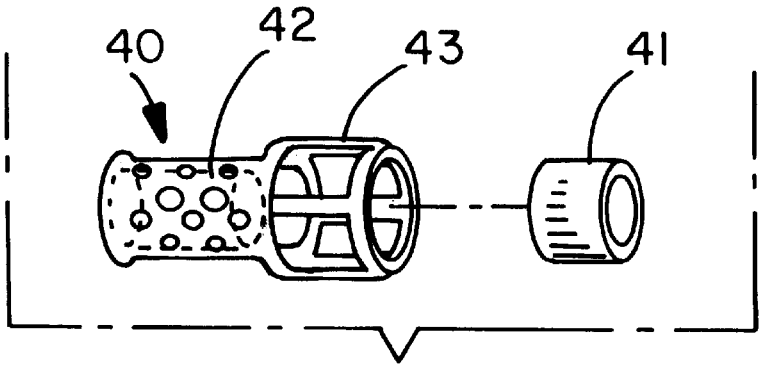

FIG. 12 illustrates another form of the embodiment in which the distal part 41 comes to lodge completely, for example by friction, in the proximal part 42 extending toward its extremity in a sufficiently perforated supporting structure 43. In this embodiment, the choke part 42 is integrated into the proximal part.

It will be understood that, for the requisite according to the invention and its utilization, numerous variants of constructions and details exist which are incorporated into the scope of the protection sought by this patent application.

The invention relates to all new and inventive aspects, taken separately or in whatever combination, and divulged in this description.

The invention therefore puts forward a simple, economic, compact, hygienic requisite for smokers that very considerably limits the emission of side-stream smoke, enabling easy relighting of a cigarette, having a ludic aspect with numerous modes of utilization and combining the qualities of flavor with safety and ease of use.

What is claimed is:

1. Requisite for reducing the quantity of smoke emanating from the smoldering tip of a cigarette consisting of an elongated ring whose circular hole enables the aforesaid ring to slide with friction along the aforesaid cigarette, under the influence of the fingers of the user, characterized in that the ring comprises at least a proximal part to be oriented on the side for inhaling the cigarette, made of a dimensionally stable material, and a distal part destined to receive or be close to the smoldering tip of the cigarette made of a different material, utilized for manufacturing pipe bowls, wherein the proximal part comprises holes traversing the wall and enabling the ventilation of the body of the cigarette under this segment, the perforated surface of the proximal segment being greater than 20%, the distal part being imperforate.

2. A cylindrical sleeve for reducing the quantity of smoke emanating from the smoldering tip of a cigarette consisting of an elongated ring whose circular hole enables the aforesaid ring to slide with friction along the aforesaid cigarette, under the influence of the fingers of the uses, wherein the ring comprises at least a perforated proximal part to be oriented on the side for inhaling the cigarette, made of a dimensionally stable material, and an imperforate distal part destined to receive or be close to the smoldering tip of the cigarette made of a different material, said material being selected from the group consisting of wood, meerschaum or terra cotta, and wherein the proximal part comprises a cylindrical wall having holes traversing the wall which form a perforated surface that comprises 20% or more of the proximal segment.

3. A cylindrical sleeve according to claim 2, wherein the cylindrical wall comprises an annular flange on each of its extremities.

* * * * *